US006805581B2

(12) United States Patent
Love

(10) Patent No.: US 6,805,581 B2
(45) Date of Patent: Oct. 19, 2004

(54) ELECTRICAL OUTLET AND CORD COVER

(75) Inventor: Mark Love, Calgary (CA)

(73) Assignee: Mark Edward Walker Love, Calgary (CA)

( * ) Notice: Subject to any disclaimer, the term of this patent is extended or adjusted under 35 U.S.C. 154(b) by 0 days.

(21) Appl. No.: 10/281,987

(22) Filed: Oct. 29, 2002

(65) Prior Publication Data

US 2004/0082217 A1 Apr. 29, 2004

(51) Int. Cl.[7] ..... H01R 13/60

(52) U.S. Cl. ..... 439/535; 439/652; 439/929; 439/501; 439/367; D13/139.4

(58) Field of Search ..... 439/535, 652, 439/719, 929, 501, 131, 134, 135, 136, 149, 521, 141, 367, 142; D13/139.4, 139.5, 139.8, 154, 156

(56) References Cited

U.S. PATENT DOCUMENTS

| | | | | | |
|---|---|---|---|---|---|
| 4,070,078 | A | | 1/1978 | Chrones | |
| 4,603,932 | A | | 8/1986 | Heverly | |
| 5,078,614 | A | | 1/1992 | Shotey | |
| D354,345 | S | * | 1/1995 | Liu | D23/411 |
| 5,488,208 | A | * | 1/1996 | Seewald | 200/43.22 |
| 5,596,479 | A | * | 1/1997 | Campbell et al. | 361/643 |
| 5,899,761 | A | | 5/1999 | Crane et al. | |
| 5,906,517 | A | | 5/1999 | Crane et al. | |
| 5,924,892 | A | * | 7/1999 | Ferracina | 439/501 |
| 6,017,228 | A | | 1/2000 | Verbeek et al. | |
| 6,027,372 | A | * | 2/2000 | Lai et al. | 439/573 |
| 6,042,426 | A | | 3/2000 | Byrne | |
| D428,598 | S | * | 7/2000 | Carter-Williams et al. | D13/154 |
| 6,087,594 | A | * | 7/2000 | Chou | 174/135 |
| 6,109,958 | A | * | 8/2000 | Ke | 439/535 |
| 6,213,616 | B1 | * | 4/2001 | Chien | 362/84 |
| 6,270,233 | B1 | * | 8/2001 | Holland | 362/154 |
| D450,038 | S | * | 11/2001 | Yu | D13/139.4 |

* cited by examiner

*Primary Examiner*—Tho D. Ta
(74) *Attorney, Agent, or Firm*—Andrew R. Hicks; Borden Ladner Gervais LLP

(57) ABSTRACT

An electrical outlet and cord management system is described for connection to a mains power supply or a data source. The system includes a tower including a base and at least one electrical outlet with surge protection for selective connection of at least one electrical device having an electrical cord and a cover for selective connection to the tower, the cover for covering at least one electrical outlet and electrical cord and for containing and managing the electrical cord.

15 Claims, 4 Drawing Sheets

ELECTRICAL OUTLET AND CORD COVER

FIELD OF THE INVENTION

The invention generally relates to a free-standing electrical outlet system with a protective cover for managing electrical cords.

BACKGROUND INFORMATION AND PRIOR ART

Many work environments require the use of multiple electrical outlets in a small space to provide electricity to various electrical devices. As is well known, electric outlets, electric plugs and electric cords pose a danger to people and, in particular, to young children. These risks range from electrical shock from improper handling of the plugs and outlets to the inadvertent entanglement with cords with the result that the electrical devices may fall causing injury to a person or damage to equipment. In an environment where there are many outlets, such as around computers, this danger is particularly acute.

Another risk from exposed outlets is that contaminating debris and liquids may cause an electrical short or electrical fire if the contaminants get into exposed outlets.

The prior art reveals various devices to address some of the safety needs required to prevent or minimize the above hazards. For example, U.S. Pat. Nos. 5,899,761 and 5,906,517 each teach electrical power bars with electrical outlets and covers for the power bars. Although these patents teach covering the outlets, such devices require a substantial amount of space on a desktop and do not provide a system for managing the cords of electrical devices plugged into the outlets. Further, these patents do not teach protecting electrical outlets from liquids.

U.S. Pat. No. 6,017,228 discloses an electrical power bar housed in a rectangular structure. Although this patent also teaches covering the electrical outlets, it requires a large amount of space on a desktop and does not teach covering the electrical outlets from various contaminants and in particular liquids which could potentially seep between its cover and hinge.

Accordingly, although the prior art teaches various structures for housing and covering outlets, the prior art does not provide a tower system which provides numerous electrical outlets and which manages the cords of plugged-in devices within a small space.

Accordingly, and in order to address the above problems and the deficiencies in the prior art, there has been a need for an electrical outlet and cord system providing:

1. a free-standing tower which reduces the surface area required for numerous electrical outlets on a floor or desktop;
2. a cover which protects people and, in particular, children from electrical outlets;
3. a cover which protects electrical outlets from contamination by debris and liquids; and
4. a cord management system which minimizes the risks to people and equipment from disorganized cords by providing an effective system for storing and organizing electrical cords associated with multiple electrical devices.

SUMMARY OF THE INVENTION

In accordance with the invention, there is provided an electrical outlet and cord management system for operative connection to a mains power supply or a data source comprising:

a tower including a base and at least one electrical outlet for selective connection of at least one electrical device having an electrical cord; and a cover for selective connection to the tower; the cover for covering at least one electrical outlet and electrical cord and for containing and managing the electrical cord.

In a more specific embodiment, there is provided an electrical outlet and cord management system for operative connection to a mains power supply or a data source comprising:

a tower including a base having a diameter wider than the tower and a plurality of electrical outlets for selective connection of electrical devices having electrical cords; and, a cover extending from the top of the tower to the base and defining a gap between the cover and the base when the cover is attached to the base; the cover for selective and operative connection to the tower and for containing and managing the electrical cord.

BRIEF DESCRIPTION OF THE DRAWINGS

The invention is described with reference to the following drawings in which.

DETAILED DESCRIPTION OF THE INVENTION

System Overview

Figure 1:
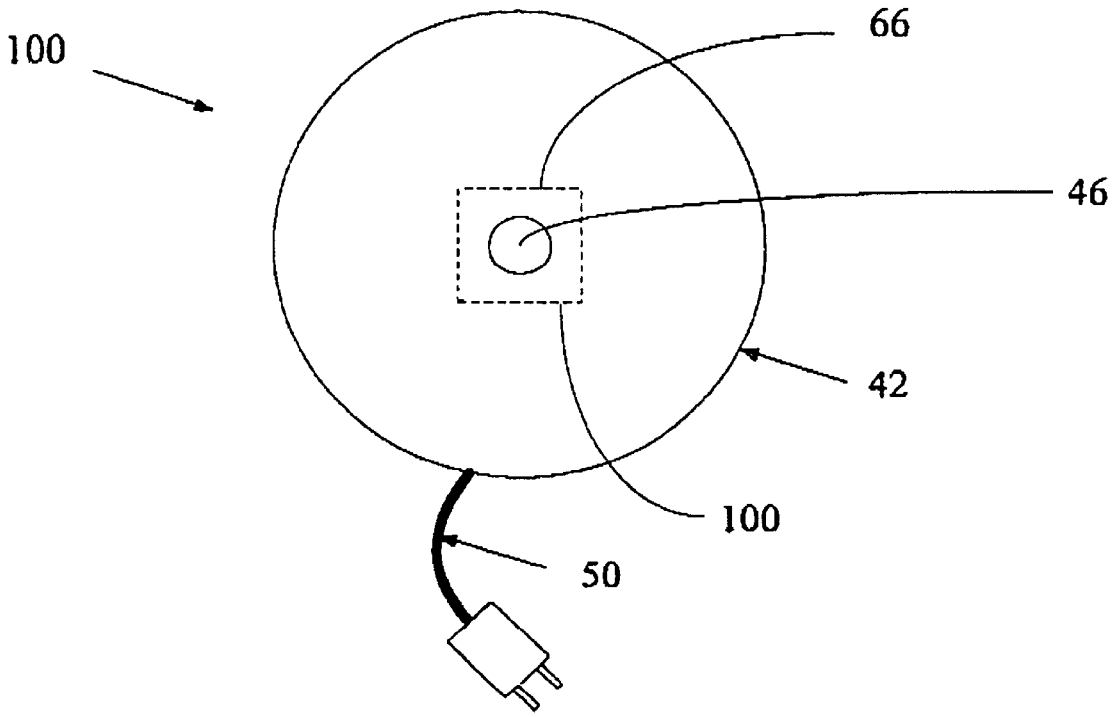
FIG. 1 is a top view of an electrical outlet tower and cover in accordance with one embodiment of the invention with the cover attached.

With reference to the Figures, an electrical outlet system 100 is described. The system 100 generally includes a base 64, a tower 66, a plurality of electrical outlets 62 about the tower, a cover 42, a mains plug 50 which may also include a power and reset switch 52.

The electrical outlet system 100 is placed where required, such as on a floor or desktop, to provide electricity for several electrical devices from a single mains power supply. After connecting the mains plug 50, the cover 42 is removed and various electrical devices are connected to the outlets 62 in the normal manner but preferably starting with the lowermost outlet at the bottom of the tower. Before each device is plugged in to the tower 66, any excess cord that would normally extend beyond the tower 66 if the cord were stretched out is coiled and placed against the tower 66 or wrapped around the tower 66 near the base 64. The device's plug is then plugged in to the tower 66. After all of the electrical devices have been plugged in and their respective cords organized, the cover 42 is placed over and around the tower and any electrical cords and secured to the tower so as to cover both the outlets and electrical cords. The mains plug 50 is plugged into a mains power supply to provide power to the electrical devices which may require activation of a power switch 52.

As indicated above, as the cover 42 is placed on the tower 66, the various cords are coiled and placed against or around the tower 66 where they are retained between the cover 42 and the base 64 thereby restricting movement of the electrical cords and reducing the length of free cord around the tower 66.

Various embodiments of the system are described in greater detail below:

The tower 66 includes a plurality of electrical outlets 62, a base 64, a mains plug 50 and an optional power and reset switch 52. The tower 66 would normally be positioned within close proximity of electrical devices and a mains power supply to allow the mains plug 50 to be plugged in.

Whilst the Figures show standard electrical outlets, the tower 66 may include other outlet types including data ports for data and fax communication lines and other connectors for computer peripheral equipment. In such an embodiment, the base 64 may be provided with additional connectors (male or female) to permit connection of the system to appropriate electrical devices. The tower 66 preferably includes a surge protection circuit including a reset switch for protecting electrical devices connected to the tower against voltage and current spikes.

Figure 2A:
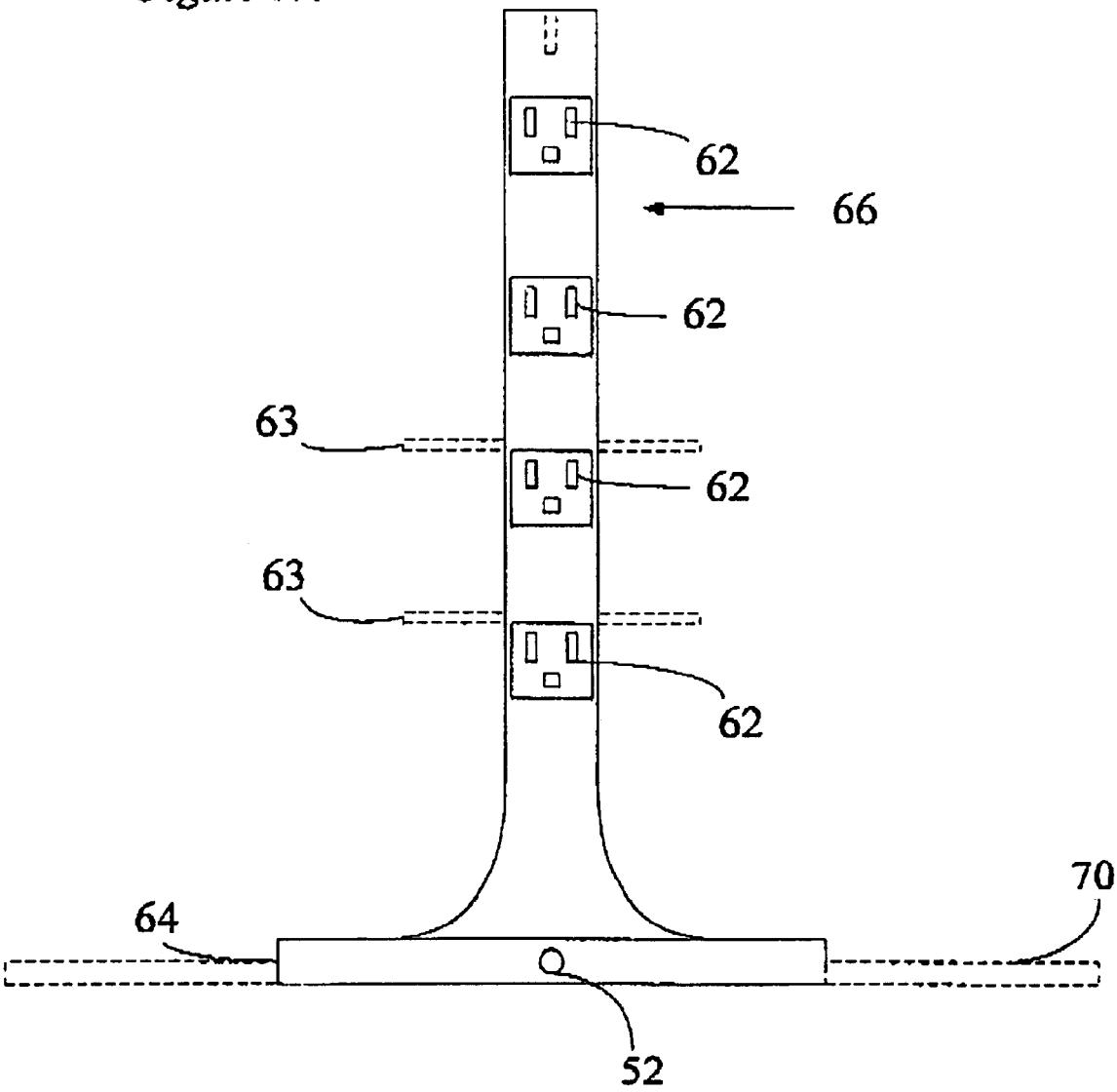
FIG. 2*a* is a front elevation view of the electrical outlet tower in accordance with one embodiment of the invention with the cover removed showing optional trays.
Figure 2B:
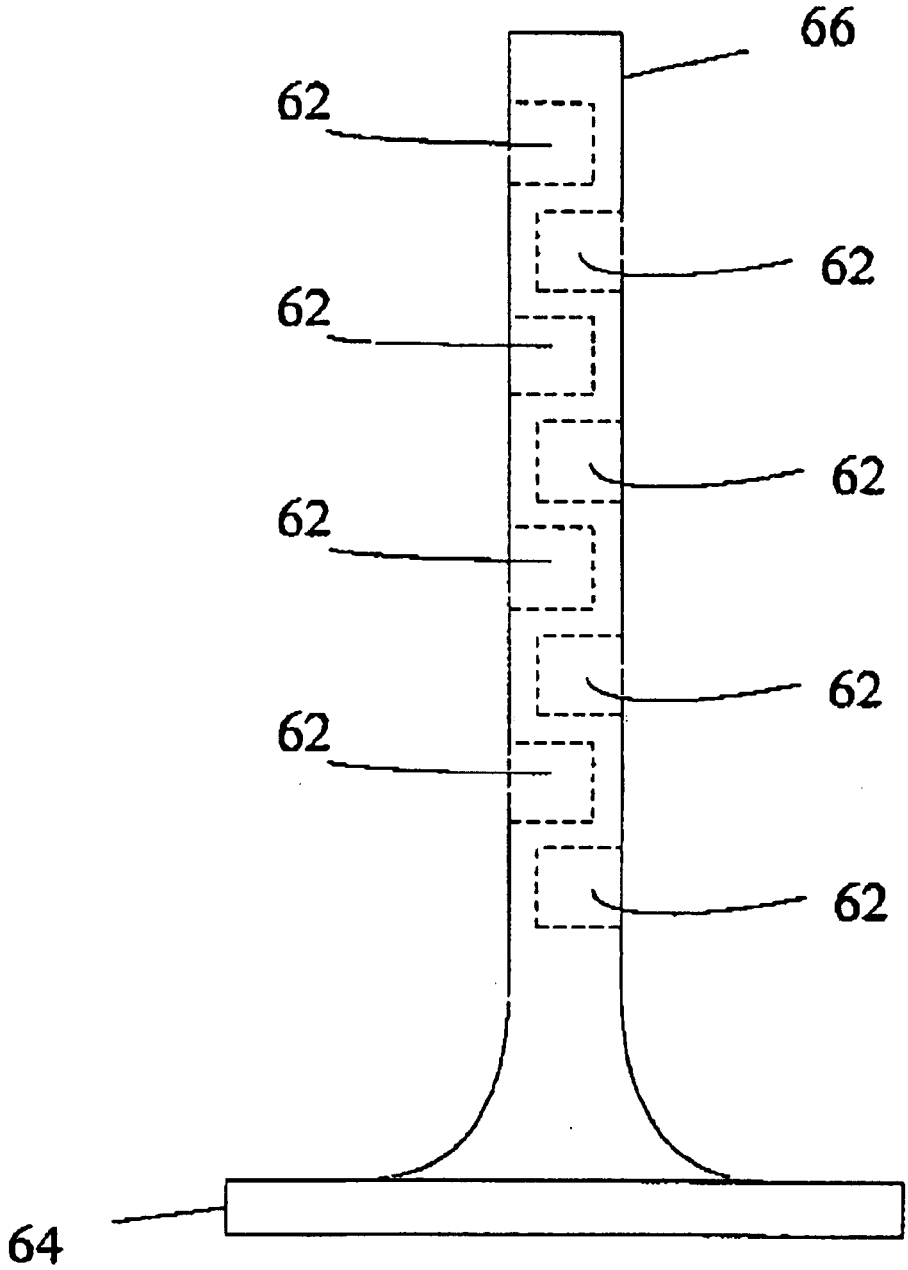
FIG. 2*b* is a schematic cross-sectional view of the electrical outlet tower in accordance with one embodiment of the invention showing alternative and stepped outlets on opposite sides of the tower; and, FIG. 3 is a front elevation view of the assembled electrical outlet and cover in accordance with one embodiment of the invention.

In one embodiment, the tower is generally a rectangular cuboid. Opposite sides of the tower 66 include outlets 62 arranged vertically along the sides of the tower (FIGS. 2*a* and 2*b*). The vertical spacing between the outlets on each side ensures that the outlets 62 on the other side of the tower 66 are not directly across from each other in order to minimize the overall volume of the tower 66. The bottom end of the tower 66 tapers outward to form a circular base 64 of a larger diameter to provide stability to the tower 66. The base may include a securing system for firmly attaching the base to a horizontal or vertical surface such as appropriate holes to allow the base to be screwed or bolted to such a surface or an adhesive for gluing the base to the surface. As such, the tower 66 can be attached to a wall, desktop or other fixture such that the tower 66 extends at any angle to the horizontal or vertical to conserve space or provide easier access to electrical devices.

The tower may also include trays 63 or projections which extend outwardly to assist in the support of electrical cords that are wrapped around the tower 66.

In another embodiment, the base may include horizontally protruding spokes 70 for placement beneath surrounding equipment to increase the stability of the tower 66.

Still further, the base 64 can be made of a heavier material than the tower 66 to provide more stability for the tower 66 by lowering the center of gravity of the tower 66.

Figure 3:
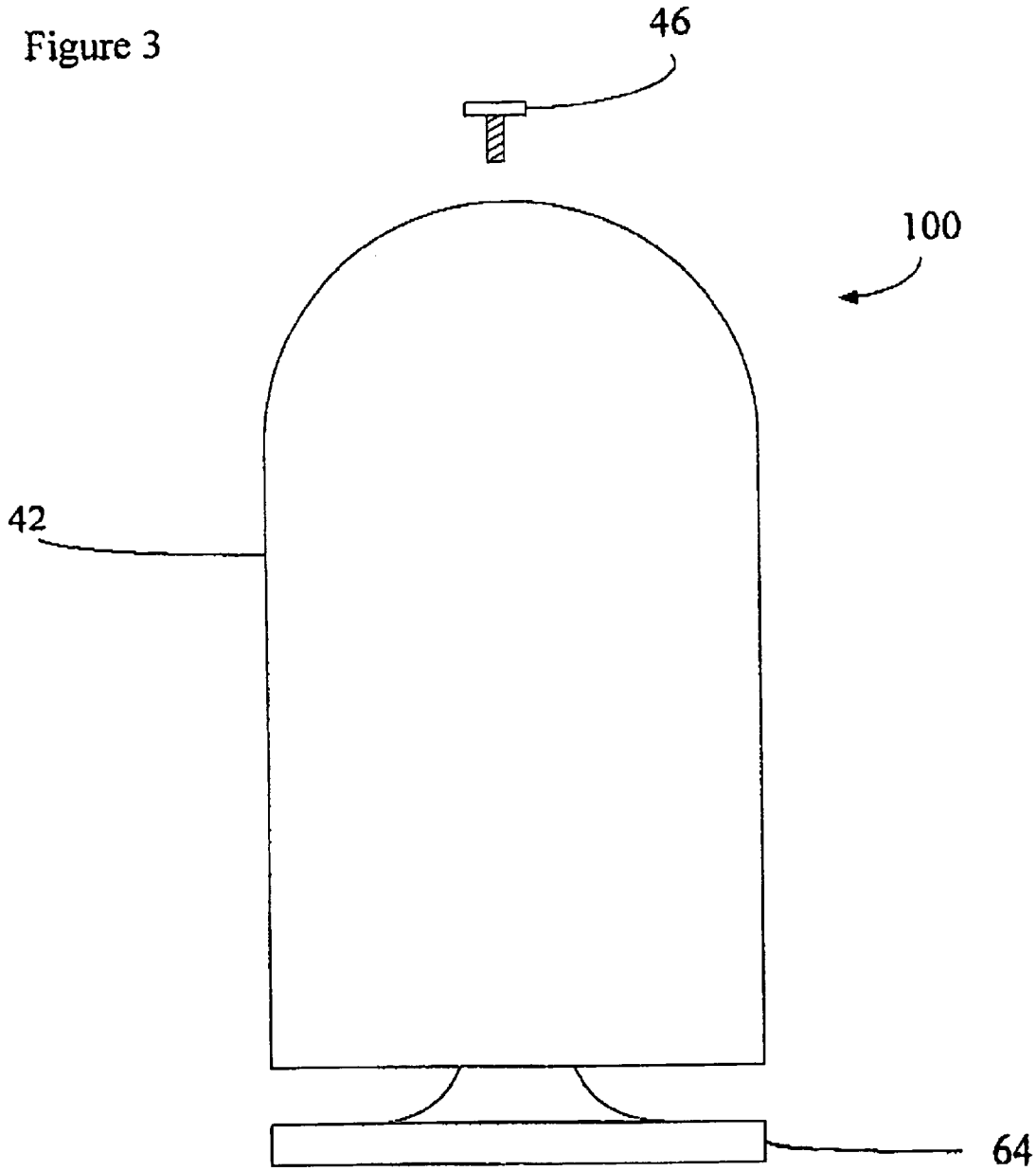

The cover 42 is preferably an open-ended casing extending between the top of the tower 66 and base 64 of the tower 66. The top of the casing is adapted for connection to the tower 66 and the bottom of the casing adapted to allow the passage of electrical cords from the inside of the tower 66 to the outside. The cover 42 may form a gap with the base 64 as shown in FIG. 3 or engage with the base 64 and include a number of small openings to allow the through-passage of the electrical cords. As described above, once all of excess cord has been coiled and the electrical devices plugged in to the electrical outlets 62, the cover 42 is lowered over the tower 66 and the cords and the cover 42 are secured by appropriate fastening devices such as a screw 46.

The connection of the cover 42 to the tower 66 ensures that any movement of the tower 66 also moves the cover 42 which provides additional safety by covering the outlets 62 in the event that the tower 66 is knocked over.

In further embodiments the cover 42 may be designed to include decorative features and shapes including auxiliary lighting (including but not limited to strobe lights, neon effects, dramatic lighting), holograms and fluid flowing through the cover 42 to provide lighting effects.

The top of the cover 42 is preferably arcuate in order to minimize the horizontal surfaces which may otherwise collect dust and to provide additional strength in the cover 42.

The cover 42 is preferably made of a durable material resilient to denting from falling debris for providing greater protection for the tower 66 and includes a smooth surface to avoid beading of liquids exposed to the cover 42. Such materials may include appropriate plastics or metals as are known in the art.

What is claimed is:

1. An electrical outlet and cord management system for operative connection to a mains power supply or a data source comprising:

a free-standing tower including a base having a diameter wider than the diameter of the tower and at least one electrical outlet for selective connection of at least one electrical device having an electrical cord; and, a cover for selective connection over and around the tower; the cover for enclosing the tower and for covering the at least one electrical outlet and electrical cord, the cover also defining a volume for containing and managing the electrical cord and a gap between the base and cover allowing the passage of electrical cord between thee base and the cover when attached to the tower.

2. The system of claim 1 wherein the tower includes a surge protection circuit operatively connected to at least one electrical outlet for providing surge protection to the circuit.

3. The system of claim 1 wherein the tower includes a data port for connecting a data device to the tower.

4. The system of claim 1 wherein the base includes horizontally protruding stabilzing spokes.

5. The system of claim 1 wherein the cover extend from the top of the tower to the base and the cover has a lower edge with at least one opening allowing the passage of cords between the interior and exterior of the cover.

6. The system of claim 1 wherein the cover extends from the top of the tower towards the base and defines a gap between the cover and the base when the cover is attached to the tower.

7. The system of claim 1 wherein the cover includes an arcuate top.

8. The system of claim 1 wherein the cover includes a right fixture operatively connected to the tower for providing a light source.

9. The system of claim 1 wherein the tower includes at least one tray adjacent an electrical outlet to assist in supporting electrical cord wrapped around the tower.

10. The system of claim 1 wherein the base includes an attachment system for attaching the base to a surface.

11. The system of claim 10 wherein the base includes at least one hole adapted for bolting or screwing the base to the surface.

12. The system of claim 10 wherein the attachment system includes an adhesive surface on the underside of the base for bonding the base to the surface.

13. The system of claim 1 wherein the cover includes a fastening device for operative connection of the cover to the tower.

14. The system of claim 13 wherein the cover is attached to the tower by a screw.

15. An electrical outlet and cord management system for operative connection to a mains power supply or a data source comprising:

a free-standing tower including a base having a diameter wider than the diameter of the tower and a plurality of electrical outlets for selective connection of electrical devices having electrical cords; and, a cover for selective connection over and around the tower, the cover extending from the top of the tower to the base for enclosing the tower and defining a gap between the cover and the base when the cover is attached to the tower for containing and managing the electrical cord.

* * * * *